US008496491B2

(12) United States Patent
Baek et al.

(10) Patent No.: US 8,496,491 B2
(45) Date of Patent: Jul. 30, 2013

(54) ROTATED ELECTRICAL CONNECTOR UNIT

(75) Inventors: Seung Seok Baek, Tokyo (JP); Koichi Kiryu, Shimotakai-gun (JP)

(73) Assignee: Fujitsu Component Limited, Tokyo (JP)

( * ) Notice: Subject to any disclaimer, the term of this patent is extended or adjusted under 35 U.S.C. 154(b) by 14 days.

(21) Appl. No.: 13/326,620

(22) Filed: Dec. 15, 2011

(65) Prior Publication Data

US 2012/0171882 A1 Jul. 5, 2012

(30) Foreign Application Priority Data

Jan. 4, 2011 (JP) ..... 2011-000165

(51) Int. Cl.
*H01R 29/00* (2006.01)

(52) U.S. Cl.
USPC ..... 439/188; 200/51.09

(58) Field of Classification Search
USPC ..... 439/11, 13, 17, 21, 22, 24, 25, 188, 439/333; 200/51.09
See application file for complete search history.

(56) References Cited

U.S. PATENT DOCUMENTS

| | | | | | |
|---|---|---|---|---|---|
| 3,475,570 | A | * | 10/1969 | Appleton | 200/51.07 |
| 4,037,901 | A | * | 7/1977 | Kaszuba | 439/138 |
| 4,185,881 | A | * | 1/1980 | Foley et al. | 439/188 |
| 4,553,000 | A | * | 11/1985 | Appleton | 200/50.29 |
| 4,772,215 | A | * | 9/1988 | Falk | 439/188 |
| 5,071,360 | A | * | 12/1991 | Lindow et al. | 439/133 |
| 5,113,045 | A | * | 5/1992 | Crofton | 200/51.09 |
| 7,008,247 | B2 | * | 3/2006 | Anzai | 439/188 |
| 7,249,976 | B1 | * | 7/2007 | Watson | 439/651 |
| 7,537,472 | B1 | * | 5/2009 | Schwarz et al. | 439/188 |
| 7,931,484 | B2 | * | 4/2011 | Chen | 439/188 |
| 7,982,145 | B2 | * | 7/2011 | Yuba et al. | 200/51 R |
| 8,123,539 | B2 | * | 2/2012 | Nakamura et al. | 439/188 |

FOREIGN PATENT DOCUMENTS

| | | |
|---|---|---|
| JP | 05-082208 | 4/1993 |
| JP | 2003-031301 | 1/2003 |

* cited by examiner

*Primary Examiner* — Thanh Tam Le
(74) *Attorney, Agent, or Firm* — IPUSA, PLLC

(57) ABSTRACT

A connector unit includes a male connector including a first plug terminal, a second plug terminal, a first switch terminal, and a second switch terminal; and a female connector including a first jack terminal, a second jack terminal, a first contact unit, and a second contact unit. The first jack terminal is connected to the first contact unit. The second jack terminal is connected to the second contact unit. The first switch terminal is configured to make the first contact unit electrically conductive and the second switch terminal is configured to make the second contact unit electrically conductive when the male connector is inserted into the female connector and rotated with respect to the female connector.

5 Claims, 16 Drawing Sheets

ROTATED ELECTRICAL CONNECTOR UNIT

CROSS-REFERENCE TO RELATED APPLICATION

This application is based upon and claims the benefit of priority of Japanese Patent Application No. 2011-000165 filed on Jan. 4, 2011, the entire contents of which are incorporated herein by reference.

FIELD

The embodiments discussed herein are related to a connector unit.

BACKGROUND

Generally, an electrical apparatus is driven by electric power supplied via a connector unit from a power supply. For example, Japanese Laid-Open Patent Publication No. 05-082208 and Japanese Laid-Open Patent Publication No. 2003-031301 disclose a connector unit including a male connector and a female connector that are fitted together and are thereby electrically connected.

However, there is a continuing demand for a smaller and safer connector unit.

SUMMARY

According to an aspect of this disclosure, there is provided a connector unit that includes a male connector including a first plug terminal, a second plug terminal, a first switch terminal, and a second switch terminal; and a female connector including a first jack terminal, a second jack terminal, a first contact unit, and a second contact unit. The first jack terminal is connected to the first contact unit. The second jack terminal is connected to the second contact unit. The first switch terminal is configured to make the first contact unit electrically conductive and the second switch terminal is configured to make the second contact unit electrically conductive when the male connector is inserted into the female connector and rotated with respect to the female connector.

The object and advantages of the invention will be realized and attained by means of the elements and combinations particularly pointed out in the claims.

It is to be understood that both the foregoing general description and the followed detailed description are exemplary and explanatory and are not restrictive of the invention as claimed.

DESCRIPTION OF EMBODIMENTS

Preferred embodiments of the present invention are described below with reference to the accompanying drawings. The same reference number is assigned to the same component throughout the accompanying drawings, and overlapping descriptions of the component are omitted. According to an embodiment, a connector unit includes a male connector and a female connector that are fitted together to electrically connect them.

(Male Connector)

Figure 1:
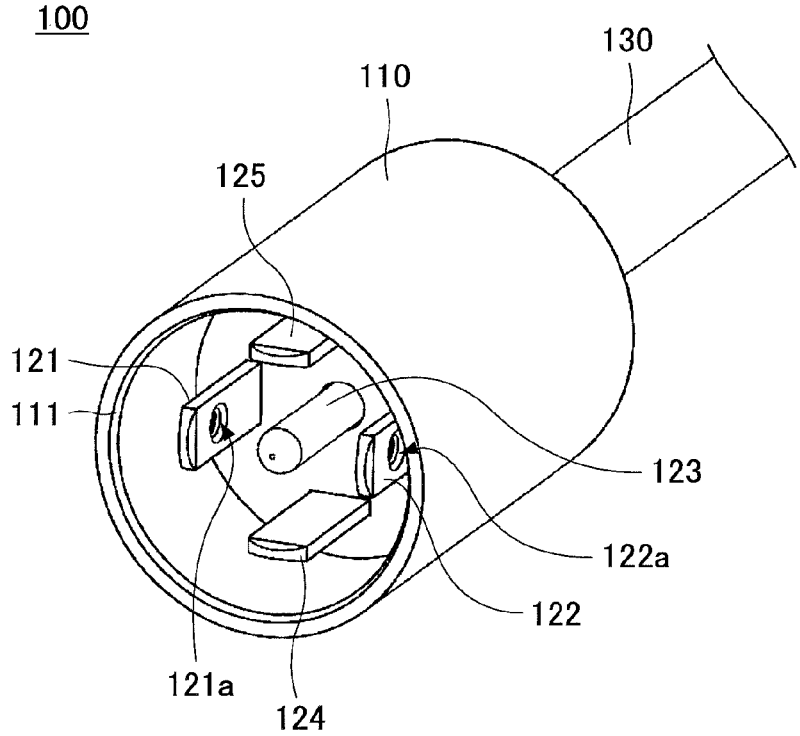
FIG. 1 is a perspective view of a male connector.
Figure 2:
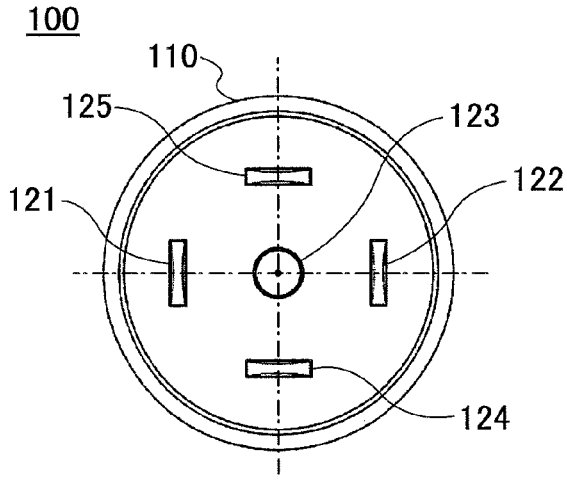
FIG. 2 is an elevational view of a male connector.

A male connector of an embodiment is described below with reference to FIGS. 1 and 2. FIG. 1 is a perspective view and FIG. 2 is an elevational view of a male connector 100 of an embodiment. The male connector 100 includes a cylindrical body 110, and includes a first plug terminal 121, a second plug terminal 122, a ground plug terminal 123, a first switch terminal 124, and a second switch terminal 125 that are provided on a first surface (or a front surface) of the body 110. The ground plug terminal 123 has a cylindrical shape and is disposed at substantially the center of the first surface of the body 110. The first plug terminal 121 and the second plug terminal 122 have a plate-like shape and are disposed to face each other across the ground plug terminal 123. In other words, the first plug terminal 121, the ground plug terminal 123, and the second plug terminal 122 are disposed on the same straight line; and the ground plug terminal 123 is disposed in the middle between the first plug terminal 121 and the second plug terminal 122. The first switch terminal 124 and the second switch terminal 125 also have a plate-like shape and are disposed to face each other across the ground plug terminal 123. In other words, the first switch terminal 124, the ground plug terminal 123, and the second switch terminal 125 are disposed on the same straight line; and the ground plug terminal 123 is disposed in the middle between the first switch terminal 124 and the second switch terminal 125.

As illustrated in FIG. 2, the first plug terminal 121, the first switch terminal 124, the second plug terminal 122, and the second switch terminal 125 are arranged in this order around the ground plug terminal 123 at intervals of about 90 degrees. In other words, the first plug terminal 121, the first switch terminal 124, the second plug terminal 122, and the second switch terminal 125 are arranged along a circumference of a circle centered around the ground plug terminal 123. A protection part 111 extends from the first surface of the body 110.

The protection part 111 has a hollow cylindrical shape and is an extension of the side surface of the body 110. A cable 130 is connected to a second surface of the body 110 which is opposite to the first surface. The tips of the first plug terminal 121, the first switch terminal 124, the second plug terminal 122, and the second switch terminal 125 are shaped like an arc and are also beveled (or chamfered).

The first plug terminal 121 has a circular hole 121*a* that engages a protrusion 221*a* of a first jack terminal 221 described later to maintain connection between the first plug terminal 121 and the first jack terminal 221. Similarly, the second plug terminal 122 has a circular hole 122*a* that engages a protrusion 222*a* of a second jack terminal 222 described later to maintain connection between the second plug terminal 122 and the second jack terminal 222. The circumferences of the holes 121*a* and 122*a* are beveled (or chamfered).

Figure 3:
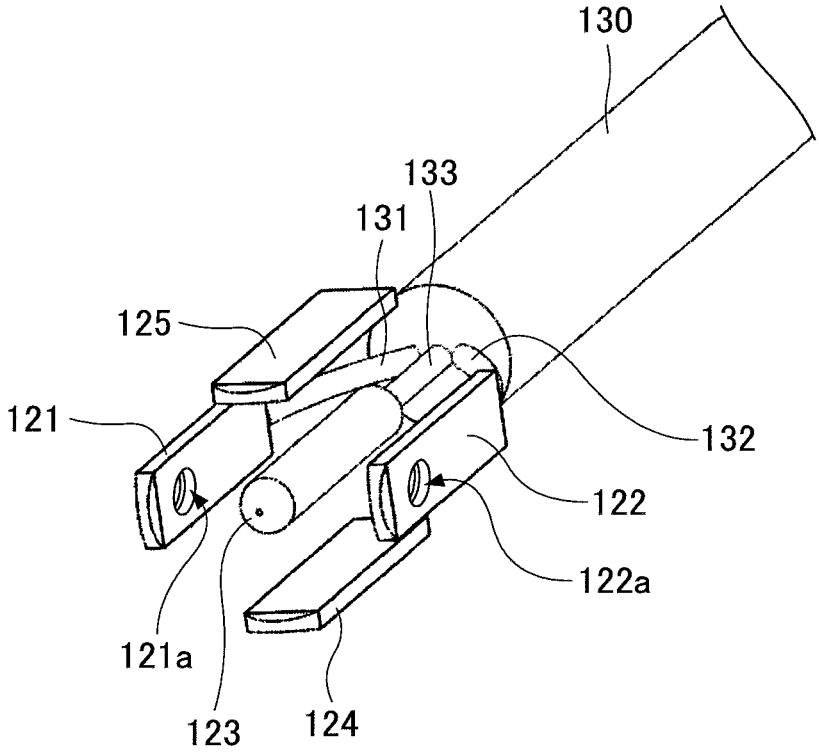
FIG. 3 is a drawing illustrating components of a male connector.

The relationships among the first plug terminal 121, the second plug terminal 122, the first switch terminal 124, the second switch terminal 125, and the cable 130 are described below with reference to FIG. 3. The cable 130 includes wires 131, 132, and 133. The first plug terminal 121 is connected to the wire 131, the second plug terminal 122 is connected to the wire 132, and the ground plug terminal 123 is connected to the wire 133. The wires 131 and 132 are used to supply electric power. The wire 133 is connected to ground potential. The first switch terminal 124 and the second switch terminal 125 are not connected to the wires of the cable 130.

(Female Connector)

Figure 4:
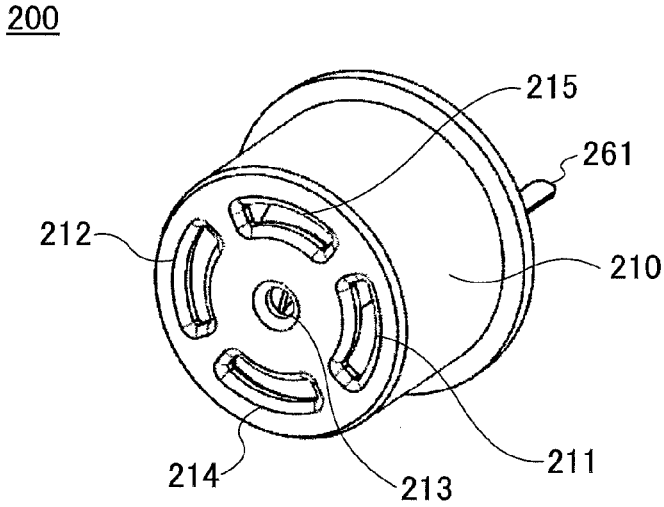
FIG. 4 is a perspective view of a female connector.
Figure 5:
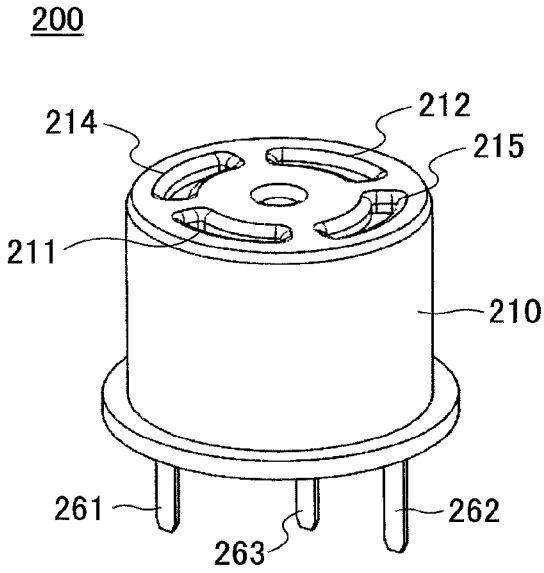
FIG. 5 is another perspective view of a female connector.
Figure 6:
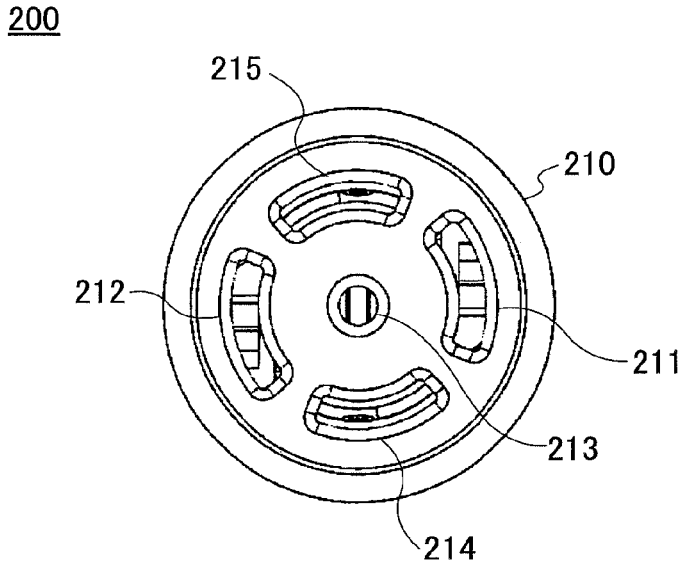
FIG. 6 is an elevational view of a female connector.

A female connector of an embodiment is described below with reference to FIGS. 4 through 6. FIGS. 4 and 5 are perspective views and FIG. 6 is an elevational view of a female connector 200 of an embodiment. The female connector 200 includes a cylindrical body 210. A circular hole 213 is formed at substantially the center of a first surface (or a front surface) of the body 210. Also in the first surface, arc-shaped holes 211, 212, 214, and 215 are formed at substantially regular intervals around the hole 213.

Figure 7:
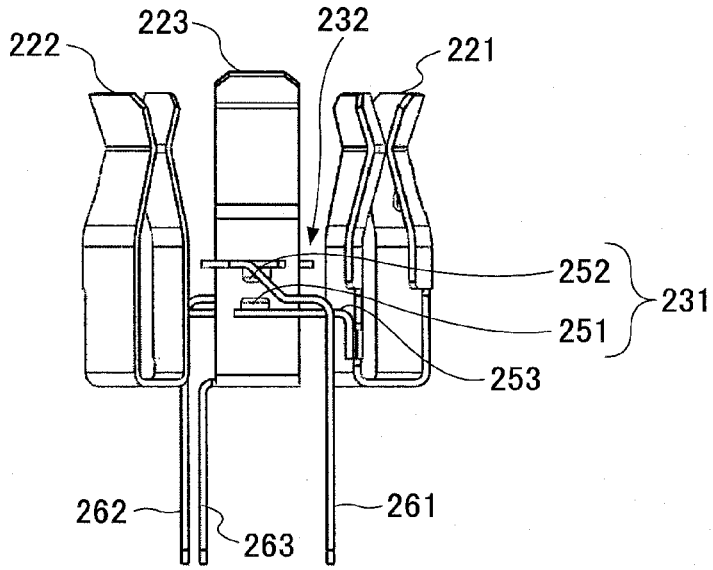
FIG. 7 is a drawing illustrating components of a female connector.
Figure 8:
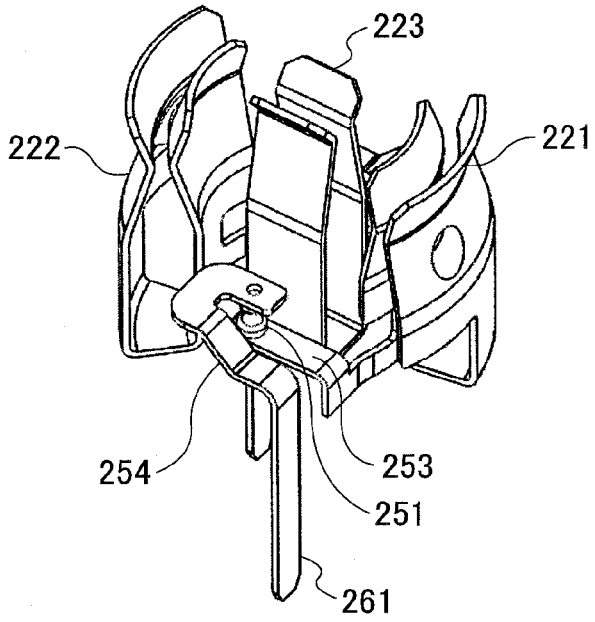
FIG. 8 is another drawing illustrating components of a female connector.

Also, as illustrated in FIGS. 7 and 8, the female connector 200 includes a ground jack terminal 223 disposed in the body 210 at a position corresponding to the hole 213, a first jack terminal 221 disposed in the body 210 at a position corresponding to the hole 211, and a second jack terminal 222 disposed in the body 210 at a position corresponding to the hole 212. Further, a first contact unit 231 is provided at a position corresponding to the hole 214 and a second contact unit 232 is provided at a position corresponding to the hole 215. In other words, the first jack terminal 221, the second jack terminal 222, the first contact unit 231, and the second contact unit 232 are arranged along a circumference of a circle centered around the ground jack terminal 223.

A cross section of the first jack terminal 221 has a U-like shape such that the first plug terminal 121 of the male connector 100 can be fitted into two facing parts of the first jack terminal 221. Another cross section of the first jack terminal 221 is shaped like an arc such that the first plug terminal 121 can be rotated around the ground plug terminal 123. Similarly, a cross section of the second jack terminal 222 has a U-like shape such that the second plug terminal 122 of the male connector 100 can be fitted into two facing parts of the second jack terminal 222. Another cross section of the second jack terminal 222 is shaped like an arc such that the second plug terminal 122 can be rotated around the ground plug terminal 123.

The first contact unit 231 includes a lower contact 251 and an upper contact 252. The upper contact 252 is connected to a first connecting terminal 261 that protrudes outward from a second surface, which is opposite to the first surface, of the body 210 of the female connector 200. The lower contact 251 is connected via a metal part 253 to the first jack terminal 221. Accordingly, when the lower contact 251 and the upper contact 252 are brought into contact and thereby connected to each other, the first jack terminal 221 is electrically connected to the first connecting terminal 261. Similarly, the second contact unit 232 includes a lower contact and an upper contact. The upper contact is connected to a second connecting terminal 262 that protrudes outward from the second surface of the body 210 of the female connector 200. The lower contact is connected via a metal part to the second jack terminal 222. Accordingly, when the lower contact and the upper contact are brought into contact and thereby connected to each other, the second jack terminal 222 is electrically connected to the second connecting terminal 262.

When the upper contact and the lower contact of each of the first contact unit 231 and the second contact unit 232 are connected to each other, electric power is supplied via the male connector 100 and the female connector 200. The ground jack terminal 223 is connected to a ground connecting terminal (third connecting terminal) 263 that protrudes outward from the second surface of the body 210 of the female connector 200.

Figure 9:
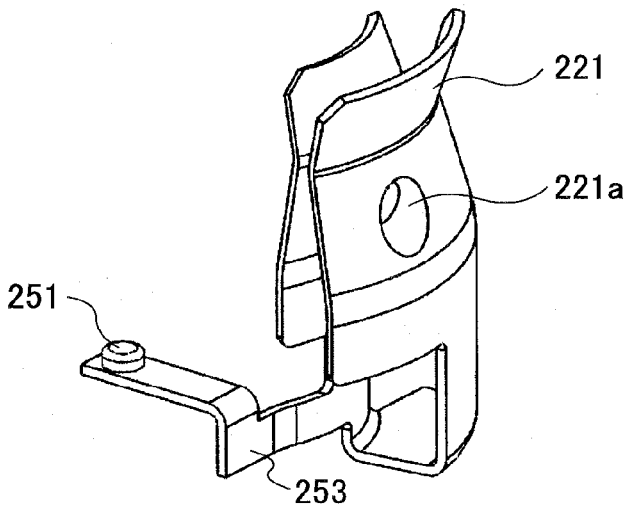
FIG. 9 is a drawing illustrating a lower contact and a first jack terminal.

Next, the first contact unit 231 and the second contact unit 232 are described in more detail. The first contact unit 231 is described with reference to FIGS. 9 and 10. The lower contact 251 of the first contact unit 231 is connected via the metal part 253 to the first jack terminal 221. The first jack terminal 221 includes a protrusion 221*a* that fits into the hole 121*a* of the first plug terminal 121 to maintain connection between the first plug terminal 121 and the first jack terminal 221. More specifically, as illustrated in FIG. 11, the protrusion 221*a* of the first jack terminal 221 has a shape corresponding to the shape of the hole 121*a* of the first plug terminal 121. Similarly, the second jack terminal 222 includes a protrusion 222*a* having a shape corresponding to the shape of the hole 122*a* of the second plug terminal 122. When the first plug terminal 121 and the second plug terminal 122 are fitted into the first jack terminal 221 and the second jack terminal 222, respectively, the openings 121*a* and 122*a* engage the corresponding protrusions 221*a* and 222*a* to maintain the connection.

Figure 10:
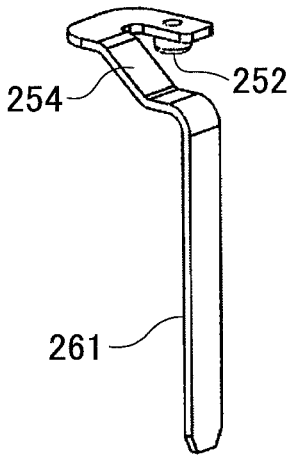
FIG. 10 is a drawing illustrating an upper contact and a first connecting terminal.
Figure 11:
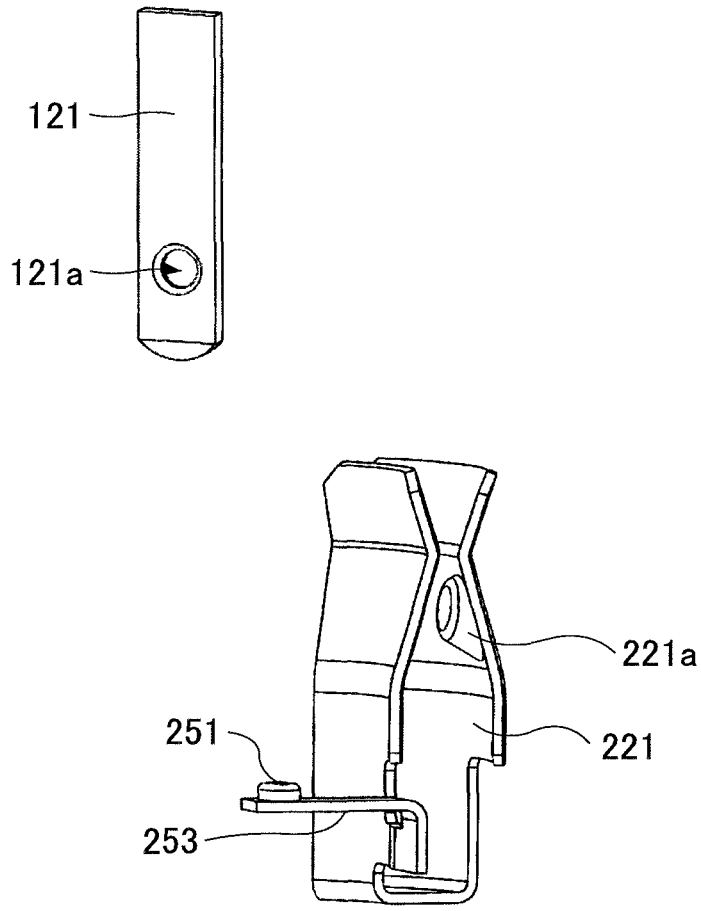
FIG. 11 is a drawing illustrating a first plug terminal and a first jack terminal.

As illustrated in FIG. 10, a plate-shaped sloping part 254 is provided between the upper contact 252 and the first connecting terminal 261. The upper contact 252, the sloping part 254, and the first connecting terminal 261 are composed of a metal material, and the sloping part 254 has elasticity. With the configuration of the connector unit as described above, when the first switch terminal 124 of the male connector 100 is brought into contact with the sloping part 254 of the female connector 200, the sloping part 254 (and its surrounding part) is deformed (or bent) downward and the lower contact 251 and the upper contact 252 of the first contact unit 231 are brought into contact with each other. More specifically, since the upper contact 252 is connected to a movable end of the sloping part 254, the upper contact 252 and the lower contact 251 contact each other and are electrically connected when the movable end of the sloping part 254 is deformed downward. The second contact unit 232 has substantially the same configuration as the first contact unit 231.

(Connection Method)

A method of connecting the male connector 100 with the female connector 200 is described below.

Figure 12:
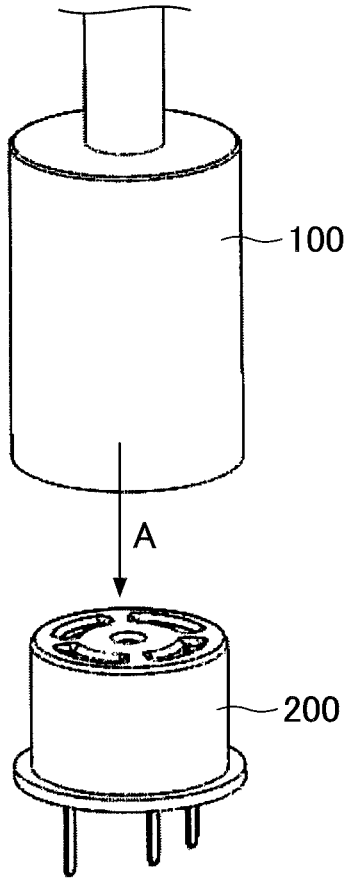
FIG. 12 is a drawing used to describe a method of connecting a male connector with a female connector.
Figure 13:
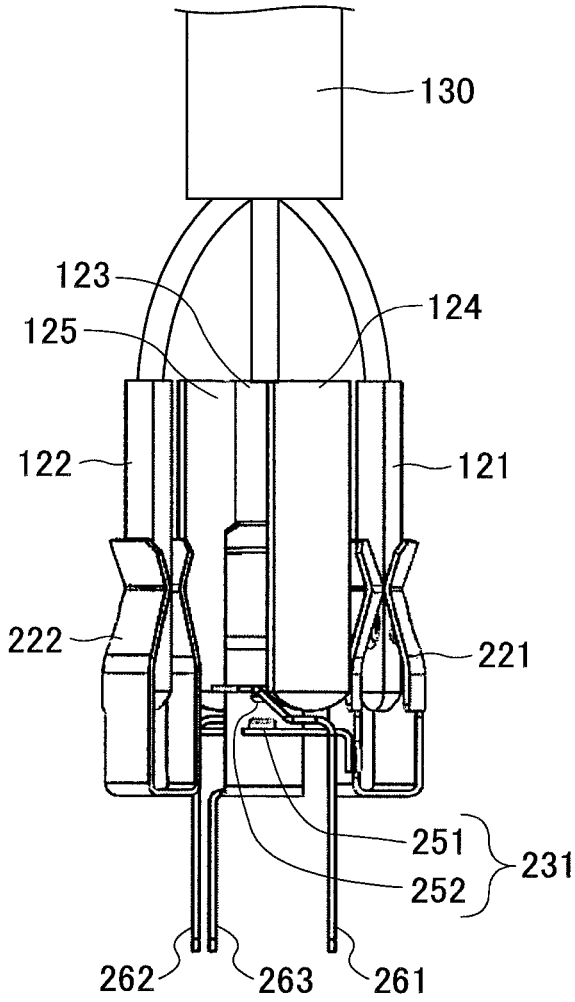
FIG. 13 is a first drawing illustrating a male connector and a female connector fitted together.
Figure 14:
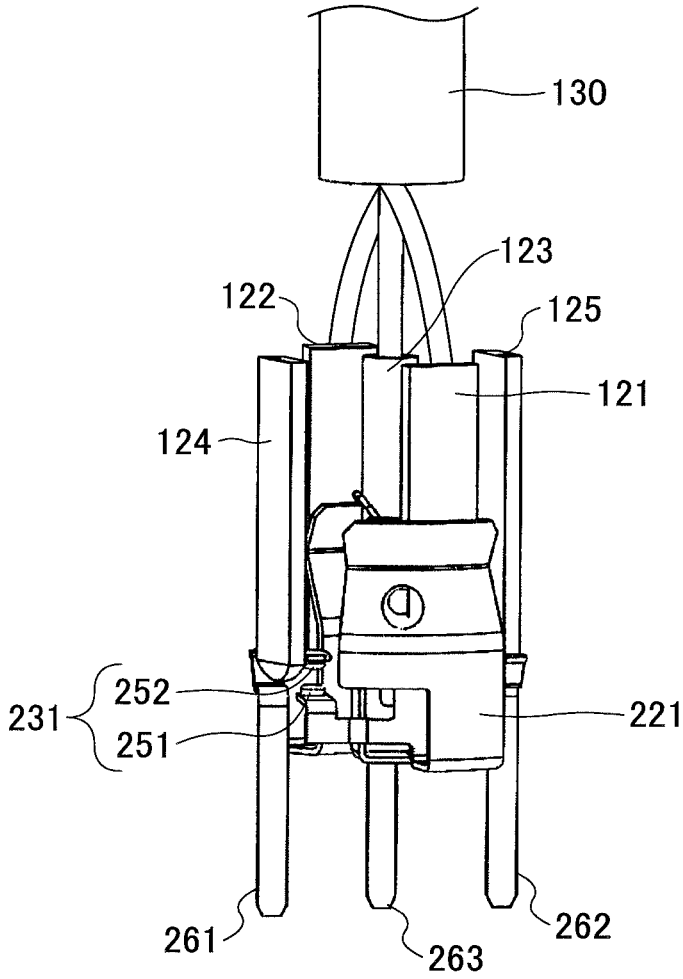
FIG. 14 is a second drawing illustrating a male connector and a female connector fitted together.

First, as illustrated in FIG. 12, the male connector 100 is inserted into the female connector 200 in a direction indicated by an arrow A. FIGS. 13 and 14 illustrate a state where the male connector 100 is inserted into the female connector 200.

FIG. 13 is a side view and FIG. 14 is a perspective view of the male connector 100 and the female connector 200 fitted together. In this state, although the first plug terminal 121 and the first jack terminal 221 are in contact with each other, the lower contact 251 and the upper contact 252 of the first contact unit 231 are not in contact. This also applies to the second plug terminal 122, the second jack terminal 222, and the second contact unit 232. Therefore, the male connector 100 is not electrically connected with the female connector 200.

Figure 15:
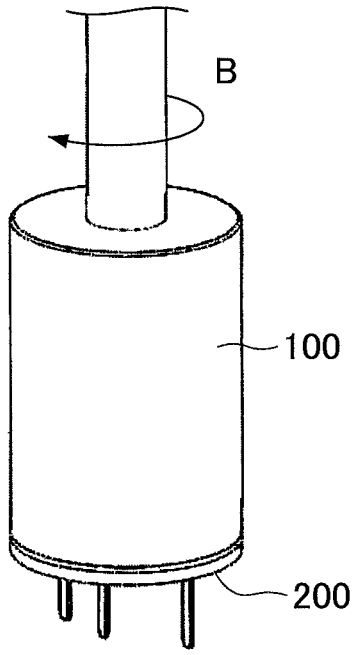
FIG. 15 is another drawing used to describe a method of connecting a male connector with a female connector.
Figure 16:
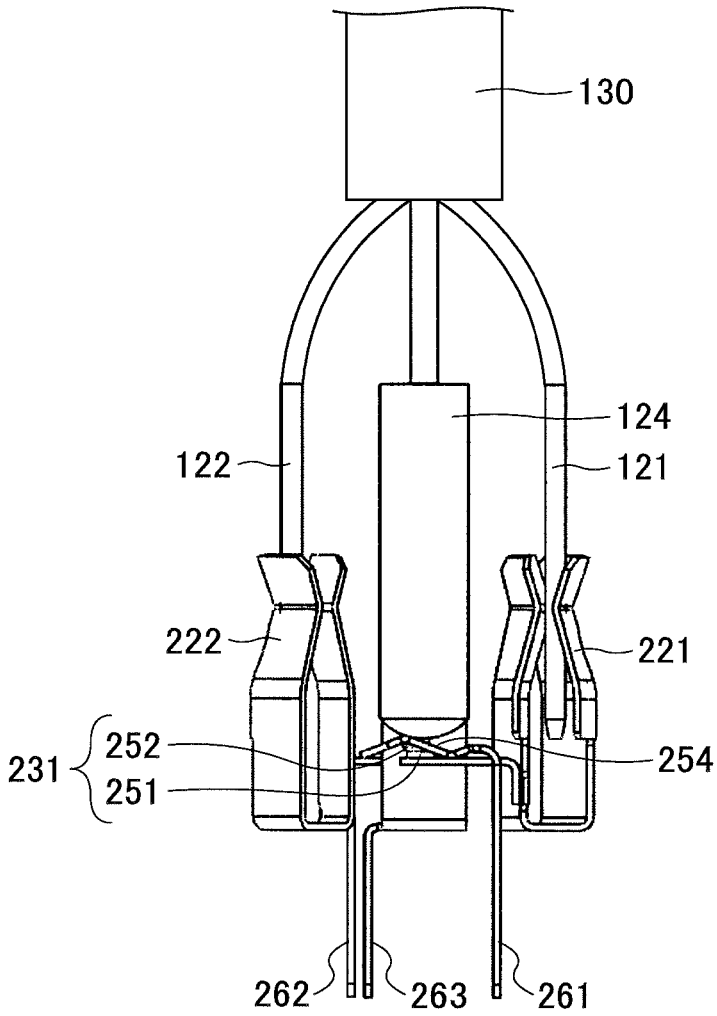
FIG. 16 is a third drawing illustrating a male connector and a female connector fitted together.
Figure 17:
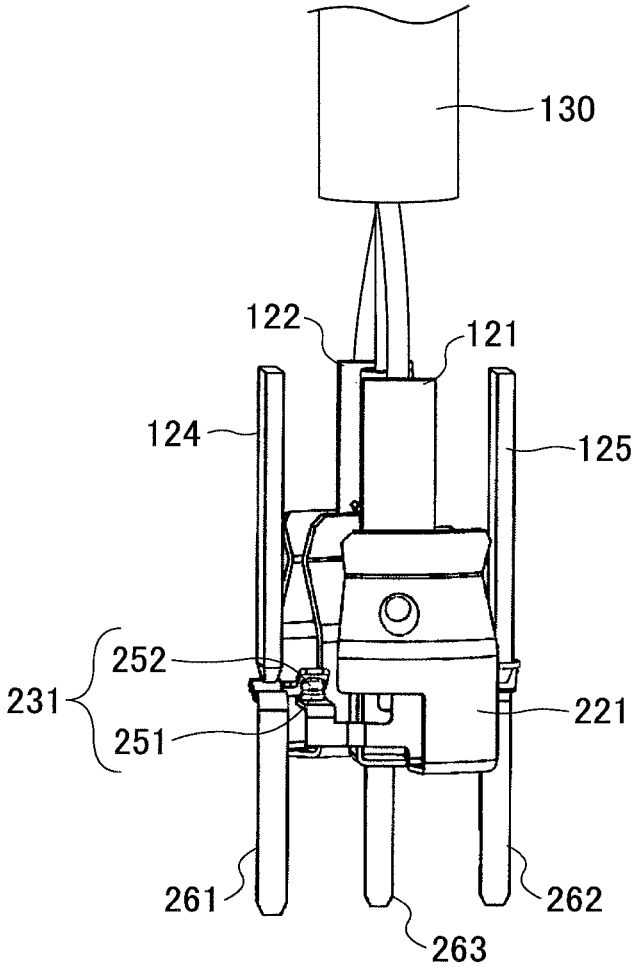
FIG. 17 is a fourth drawing illustrating a male connector and a female connector fitted together.
Figure 18:
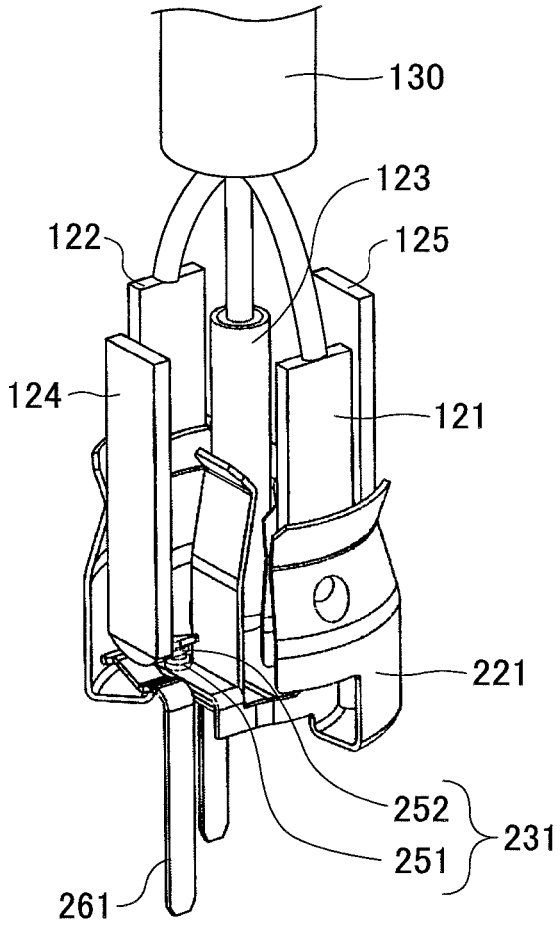
FIG. 18 is a fifth drawing illustrating a male connector and a female connector fitted together.
Figure 19:
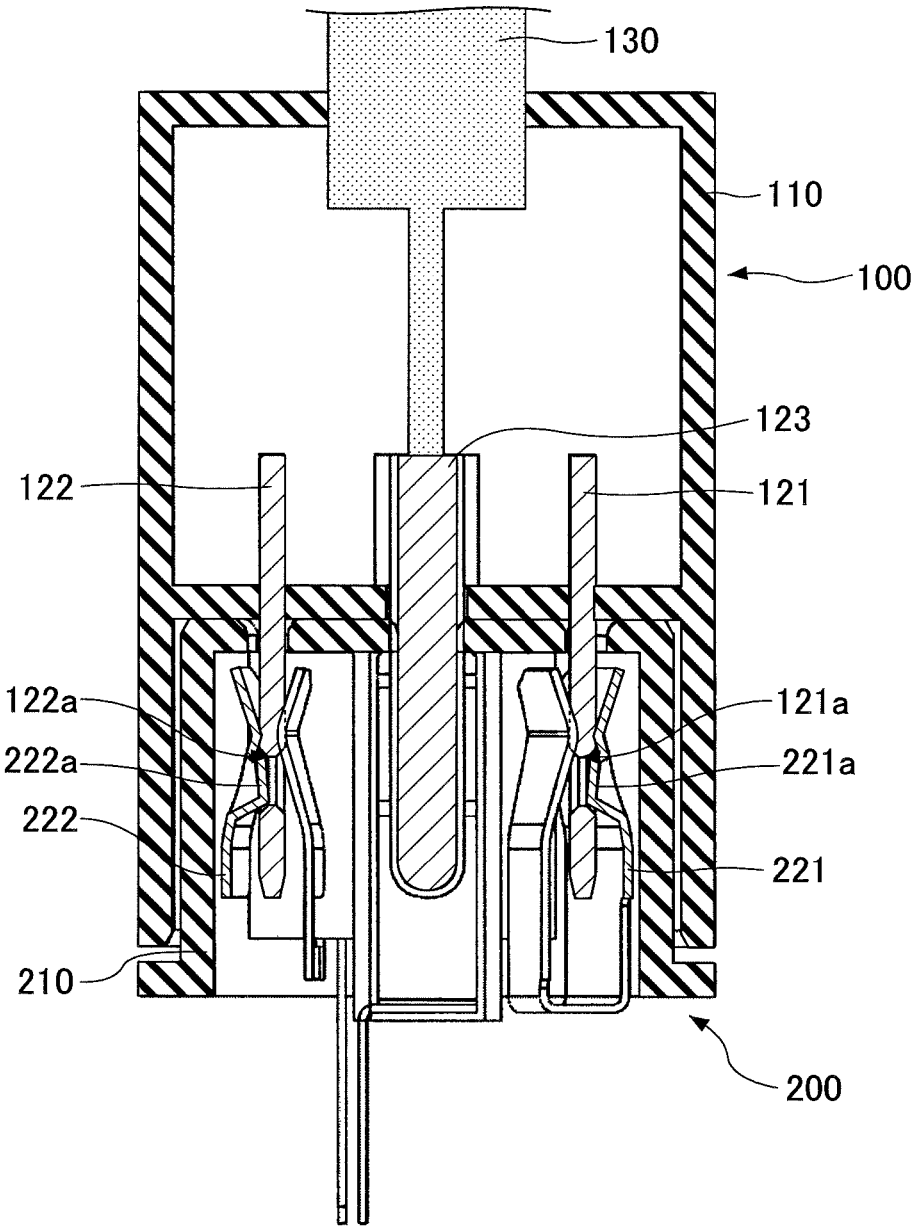
FIG. 19 is a sixth drawing illustrating a male connector and a female connector fitted together.

Next, as illustrated in FIG. 15, the male connector 100 is rotated with respect to the female connector 200 in a direction indicated by an arrow B. FIGS. 16 through 19 illustrate a state after the male connector 100 is rotated. FIG. 16 is a side view, FIGS. 17 and 18 are perspective views, and FIG. 19 is a cut-away side view of the male connector 100 and the female connector 200 fitted together. In this state, the sloping part 254 is pressed by the first switch terminal 124 and an end of the sloping part 254 is deformed (or bent) downward. As a result, the lower contact 251 and the upper contact 252 of the first contact unit 231 are brought into contact with each other, i.e., the first contact unit 231 becomes electrically conductive. Accordingly, the first plug terminal 121 is electrically connected to the first connecting terminal 261 via the first jack terminal 221 and the first contact unit 231. In a similar manner, the second contact unit 232 becomes electrically conductive. As a result, the second plug terminal 122 is electrically connected to the second connecting terminal 262 via the second jack terminal 222 and the second contact unit 232.

When the first contact unit 231 and the second contact unit 232 become electrically conductive, electric power is supplied via the male connector 100 and the female connector 200. In this state, as illustrated in FIG. 19, the protrusion 221*a* of the first jack terminal 221 is placed in the hole 121*a* of the first plug terminal 121. Similarly, the protrusion 222*a* of the second jack terminal 222 is placed in the hole 122*a* of the second plug terminal 122.

When the male connector 100 is rotated with respect to the female connector 200 in a direction opposite to the direction indicated by the arrow B in FIG. 15, the lower contact 251 and the upper contact 252 of the first contact unit 231 are disconnected from each other and the upper contact and the lower contact of the second contact unit 232 are also disconnected from each other. As a result, the first contact unit 231 and the second contact unit 232 become electrically non-conductive and the supply of electric power is stopped.

Figure 20:
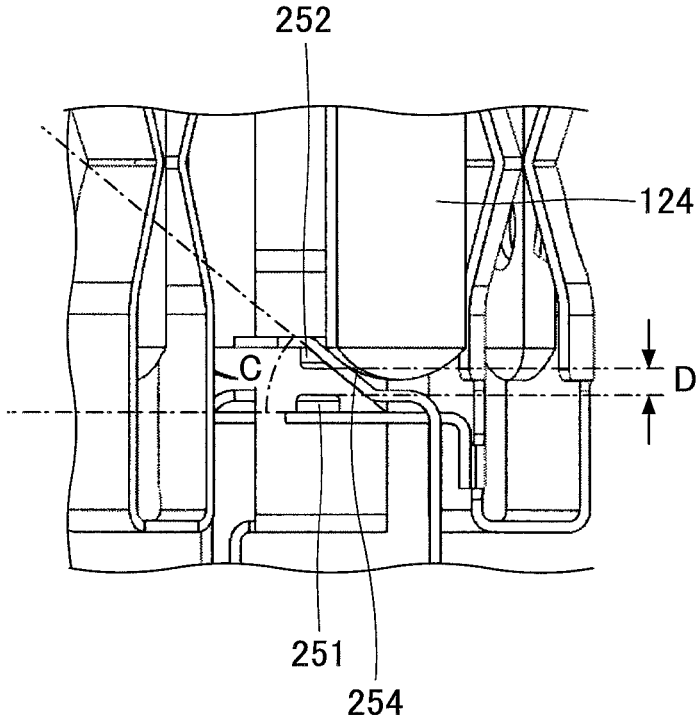
FIG. 20 is a drawing illustrating a sloping part of a female connector.

Next, the sloping part 254 is described in more detail with reference to FIG. 20. The first connecting terminal 261 includes a horizontal part and a vertical part that extends from the horizontal part at a substantially right angle with respect to the horizontal part. The sloping part 254 slopes at an angle C with respect to the horizontal part of the first connecting terminal 261. Preferably, the angle C is less than or equal to 40 degrees. A distance D between the lower contact 251 and the upper contact 252 may be determined, for example, according to the supply voltage.

With the connector unit of this embodiment, after inserting the male connector 100 into the female connector 200, the male connector 100 is rotated with respect to the female connector 200 to bring the upper and lower contacts (251, 252) of the first contact unit 231 into contact with each other and to bring the upper and lower contacts of the second contact unit 232 into contact with each other. With this configuration, electric power is supplied only after the male connector 100 is rotated. This configuration makes it possible to improve the safety of the connector unit.

The ground jack terminal 223 may be magnetized and composed of a conductive and magnetic metal material. The ground jack terminal 223 composed of a magnetic material can generate a magnetic field and the magnetic field can extinguish an electric arc generated between the upper and lower contacts of the first contact unit 231 and the second contact unit 232.

Any material having conductivity and magnetism may be used for the ground jack terminal 223. For example, a material including one or more of iron (Fe), cobalt (Co), and nickel (Ni), or a material including an alloy of two or more of these elements may be used for the ground jack terminal 223. Also, a material including one or more rare-earth elements may be used for the ground jack terminal 223. Particularly, a lanthanoid such as samarium (Sm), neodymium (Nd), or praseodymium (Pr) is preferably used to provide high magnetic force.

Using a material as described above for the ground jack terminal 223 makes it possible to provide conductivity and to extinguish an electric arc generated between the upper and lower contacts of the first contact unit 231 and the second contact unit 232 by a magnetic field, and thereby makes it possible to further improve the safety of the connector unit.

All examples and conditional language recited herein are intended for pedagogical purposes to aid the reader in understanding the invention and the concepts contributed by the inventors to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

The invention claimed is:

1. A connector unit, comprising:

a male connector including a first plug terminal, a second plug terminal, a first switch terminal, and a second switch terminal; and a female connector including a first jack terminal, a second jack terminal, a first contact unit, and a second contact unit, wherein the first jack terminal is connected to the first contact unit;

the second jack terminal is connected to the second contact unit;

each of the first contact unit and the second contact unit includes a lower contact and an upper contact;

the upper contact is connected to an end of an elastic sloping part made of a metal material;

the first switch terminal is configured to press the sloping part and cause the upper contact and the lower contact of the first contact unit to electrically contact each other; and the second switch terminal is configured to press the sloping part and cause the upper contact and the lower contact of the second contact unit to electrically contact each other, when the male connector is relatively rotated to the female connector.

2. The connector unit as claimed in claim 1, wherein the first plug terminal and the second plug terminal have holes formed therein;

the first jack terminal and the second jack terminal include protrusions corresponding to the holes; and the protrusions are configured to fit into the holes when the upper contact and the lower contact of both of the first contact unit and the second contact unit electrically contact each other.

3. The connector unit as claimed in claim 1, wherein the male connector further includes a ground plug terminal;

the first plug terminal, the second plug terminal, the first switch terminal, and the second switch terminal are arranged along a circumference of a circle centered around the ground plug terminal;

the female connector further includes a ground jack terminal; and the first jack terminal, the second jack terminal, the first contact unit, and the second contact unit are arranged along a circumference of a circle centered around the ground jack terminal.

4. A connector unit, comprising:

a male connector; and a female connector to be connected to the male connector;

the male connector includes a first plug terminal, a second plug terminal, a first switch terminal, and a second switch terminal; and the female connector includes a first jack terminal to be connected to the first plug terminal, a second jack terminal to be connected to the second plug terminal, a first contact unit that includes a pair of first contacts one of which is connected to the first jack terminal, and a second contact unit that includes a pair of second contacts, one of which is connected to the second jack terminal, wherein when the male connector and the female connector are relatively rotated while the male connector is connected to the female connector, the first switch terminal presses either one of the first contacts to cause the pair of first contacts to electrically contact each other, and the second switch terminal presses either one of the second contacts to cause the pair of second contacts to electrically contact each other.

5. A connector connectable to another connector, the connector comprising:

a first jack terminal connectable to a first plug terminal of the another connector;

a second jack terminal connectable to a second plug terminal of the another connector;

a first contact unit that includes a first contact connected to the first jack terminal and a second contact capable of contact with the first contact; and a second contact unit that includes a third contact connected to the second jack terminal and a fourth contact capable of contact with the third contact;

wherein when the connector is connected to the another connector, the first jack terminal is connected to the first plug terminal and the second jack terminal is connected to the second plug terminal while contacts of both and first contact unit and the second contact unit are not in contact, respectively, and when the connector is relatively rotated to the another connector, either the first contact and the second contact is pressed by a first switch of the another connector and are electrically contacted with each other, and either of the third contact and the fourth contact is pressed by a second switch terminal of the another connector and are electrically contacted with each other.

* * * * *